US011421715B2

(12) United States Patent
Nakajima

(10) Patent No.: US 11,421,715 B2
(45) Date of Patent: Aug. 23, 2022

(54) HYDRAULIC CONTROL CIRCUIT FOR WORKING MACHINE

(71) Applicant: Caterpillar SARL, Geneva (CH)

(72) Inventor: Hideki Nakajima, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 17/431,860

(22) PCT Filed: Feb. 13, 2020

(86) PCT No.: PCT/EP2020/025063
§ 371 (c)(1),
(2) Date: Aug. 18, 2021

(87) PCT Pub. No.: WO2020/169250
PCT Pub. Date: Aug. 27, 2020

(65) Prior Publication Data

US 2022/0112688 A1 Apr. 14, 2022

(30) Foreign Application Priority Data

Feb. 18, 2019 (JP) ..... JP2019-026298

(51) Int. Cl.
*F15B 11/16* (2006.01)
*E02F 9/22* (2006.01)
(Continued)

(52) U.S. Cl.
CPC ..... *F15B 11/165* (2013.01); *E02F 9/2004* (2013.01); *E02F 9/2235* (2013.01);
(Continued)

(58) Field of Classification Search
CPC ... F15B 11/0423; F15B 11/055; F15B 11/165; F15B 2211/253; F15B 2211/45;
(Continued)

(56) References Cited

U.S. PATENT DOCUMENTS 5,129,230 A * 7/1992 Izumi ..... E02F 9/2235 60/452
5,394,697 A * 3/1995 Hirata ..... E02F 9/2235 60/426

(Continued)

FOREIGN PATENT DOCUMENTS

JP 2571982 Y2 5/1998
JP H11303809 A 11/1999

(Continued)

OTHER PUBLICATIONS

International Search Report for related International Application No. PCT/EP2020/025018; dated Jun. 24, 2020.

*Primary Examiner* — Michael Leslie

(57) ABSTRACT

To achieve reduction of fuel consumption and enhancement of operability, in a hydraulic control circuit provided with a bypass oil passage formed by being branched from a discharge line of a hydraulic pump and extending to an oil tank, and a bypass valve having variable opening area for controlling a flow rate of the bypass oil passage, and to accurately perform pump pressure control through opening area control of the bypass valve without being affected by a condition of each time. The hydraulic control circuit is configured to perform closed-loop control of the opening area of the bypass valve so that the pump pressure is maintained at a set pressure, during nonoperation of the operation lever; on the other hand, to perform open-loop control for reducing the opening area of the bypass valve depending on the operation input of the operation lever, during an operation of the operation lever, and further configured to correct on the basis of the opening area of the bypass valve during the closed-loop control, the correspondence relationship between the operation input of the operation lever and the opening area of the bypass valve during the open-loop control.

4 Claims, 7 Drawing Sheets

(51) Int. Cl.
*E02F 9/20* (2006.01)
*F15B 11/042* (2006.01)
*F15B 11/05* (2006.01)

(52) U.S. Cl.
CPC ..... *E02F 9/2267* (2013.01); *E02F 9/2282* (2013.01); *E02F 9/2296* (2013.01); *F15B 11/0423* (2013.01); *F15B 11/055* (2013.01)

(58) Field of Classification Search
CPC ..... F04B 49/065; F04B 49/08; F04B 49/24; F04B 49/246
USPC ..... 60/452, 468
See application file for complete search history.

(56) References Cited

U.S. PATENT DOCUMENTS

| | | | | |
|---|---|---|---|---|
| 5,680,760 | A | 10/1997 | Lunzman | |
| 7,155,909 | B2 * | 1/2007 | Toji | E02F 9/2285 60/468 |
| 7,500,360 | B2 * | 3/2009 | Udagawa | E02F 9/2228 60/486 |
| 8,950,180 | B2 * | 2/2015 | Ooki | E02F 9/123 60/420 |

FOREIGN PATENT DOCUMENTS

| | | | | |
|---|---|---|---|---|
| JP | 2013127273 | A | 6/2013 | |
| WO | WO-2014061741 | A1 * | 4/2014 | E02F 9/2225 |

* cited by examiner

HYDRAULIC CONTROL CIRCUIT FOR WORKING MACHINE

This patent application is a 35 USC § 371 U.S. national stage of International Application No. PCT/EP2020/025063 filed on Feb. 13, 2020, which claims the benefit and priority of Japanese Application No. 2019-026298 filed on Feb. 18, 2019, the disclosures of which are incorporated in their entirety by reference herein.

TECHNICAL FIELD

The present invention relates to a technical field of a hydraulic control circuit for a working machine such as a hydraulic shovel.

BACKGROUND ART

Generally, hydraulic control circuits are utilized in working machines such as hydraulic shovels, for example. Some known hydraulic control circuits include a hydraulic pump of variable displacement type, a hydraulic actuator that drives the hydraulic pump as a hydraulic supply source, and a control valve for performing oil supply/discharge control to/from the hydraulic actuator on the basis of an operation of an operation lever. In order to improve fuel consumption and working efficiency, in such a hydraulic control circuit, it is required to appropriately control the flow rate and pressure of the hydraulic pump. For this reason, there is conventionally known a technique of a hydraulic control circuit including a bypass oil passage formed by being branched from a discharge line of the hydraulic pump and extending to an oil tank, a bypass valve having a variable opening area for controlling a flow rate of the bypass oil passage, and a controller for controlling a displacement varying means of the hydraulic pump and the bypass valve. (For example, see Patent Literature 1).

The hydraulic control circuit disclosed in the Patent Literature 1 is configured such that, during non-operation of an operation lever (standby state), the pump flow rate is controlled to a minimum and an opening area of a bypass valve is controlled to a position at which the opening area is restricted to a set value previously set, and on the other hand, during an operation of the operation lever, the pump flow rate is increased depending on the increase in an operation input, and the opening area of the bypass valve is controlled to a position at which the opening area is reduced depending on the operation input from the set value. By this configuration, fuel consumption improvement can be achieved during the non-operation of the operation lever, and responsiveness improvement at the time of starting the operation can be achieved. During the operation of the operation lever, the pump flow rate and the pump pressure corresponding to the operation input can also be secured.

PRIOR ART LITERATURES

Patent Literatures

[Patent Literature 1] Japanese Patent Application Laid-Open No. 2013-127273

SUMMARY OF THE INVENTION

Problems to be Solved by the Invention

Meanwhile, in the hydraulic control circuit of the Patent Literature 1, during non-operation of an operation lever, as described above, an opening area of a bypass valve is restricted to a set value, whereby pump pressure is kept to a certain value or more to improve responsiveness at the time of starting the operation. In this case, however, in order to further improve fuel efficiency by stabilizing the pump pressure, it is more desirable to perform control for keeping the pump pressure constant by feeding back a detected value of the pump pressure to opening area control of the bypass valve, that is, closed-loop control for maintaining the pump pressure at a set pressure. On the other hand, during the operation of the operation lever, because the pump pressure fluctuates depending on the status of the hydraulic actuator, the closed-loop control for feeding back the detected value of the pump pressure to the opening area control of the bypass valve is not suitable.

Therefore, there is a proposal to perform closed-loop control for maintaining the pump pressure at the set pressure during the non-operation of the operation lever, and to perform open-loop control for the opening area of the bypass valve depending on the operation input of the operation lever during the operation of the operation lever.

However, when performing closed-loop control during the non-operation of the operation lever, the opening area of the bypass valve for setting the pump pressure to the set pressure has a different value depending on conditions such as hydraulic oil temperature and individual differences of hydraulic equipment. For this reason, when the operation lever is operated to start the open-loop control, if the opening area of the bypass valve with respect to the operation input of the operation lever is previously set, then, at the time of shifting from the closed-loop control to the open-loop control, there may be a difference and discontinuity between the opening area of the bypass valve during the closed-loop control and the opening area of the bypass valve at the time of starting the open-loop control. Thus, there is a problem that the pump pressure may suddenly fluctuate at the discontinuous point, resulting in the deterioration of operability. Furthermore, if the opening area of the bypass valve in the open-loop control is previously set in correspondence with the operation input of the operation lever. However, there are problems that control of the pump pressure cannot be effected based on the opening area of the bypass valve in consideration of these conditions, because the conditions such as hydraulic oil temperatures and individual differences of hydraulic equipment are not reflected in the set value, and there are problems to be solved by the present invention.

Means for Solving the Problems

The present invention has been made to solve these problems in view of the above situation. A hydraulic control circuit for a working machine according to the invention of claim 1 includes a hydraulic pump of variable displacement type, a hydraulic actuator that drives the hydraulic pump as a hydraulic supply source, a control valve for performing oil supply/discharge controls to/from the hydraulic actuator on the basis of an operation of an operation lever, a bypass oil passage formed by being branched from a discharge line of the hydraulic pump and extending to an oil tank, a bypass valve having a variable opening area for controlling a flow rate of the bypass oil passage, and a controller for controlling a displacement varying means of the hydraulic pump and the bypass valve, wherein the controller, performs closed-loop control for maintaining a pump flow rate constant, and controlling an opening area of the bypass valve so that a pump pressure is maintained at a set pressure, during non-operation of the operation lever, and on the other hand, performs open-loop control for increasing the pump flow rate depending on the operation input of the operation lever, and reducing an opening area of the bypass valve depending on the operation input of the operation lever, during operation of the operation lever, and wherein the controller comprises a correcting means for correcting a correspondence relationship between the operation input of the operation lever and the opening area of the bypass valve in the open-loop control, on the basis of the opening area of the bypass valve during the closed-loop control.

A hydraulic control circuit for a working machine according to the invention of claim 2 is hydraulic control circuit for the working machine according the claim 1, wherein the correcting means controls the opening area of the bypass valve at the time of starting the open-loop control so that the opening area of the bypass valve does not become discontinuous at the time of shifting from the closed-loop control to the open-loop control.

A hydraulic control circuit for a working machine according the invention of claim 3 is the hydraulic control circuit for the working machine according to claim 1 or claim 2, wherein the correcting means includes a standard map indicating a correspondence relationship between an operation input of the operation lever and an opening area of the bypass valve in the open-loop control, and corrects the standard map on the basis of the opening area of the bypass valve during the closed-loop control.

A hydraulic control circuit for a working machine according the invention of claim 4 is the hydraulic control circuit for the working machine according to claim 1 or claim 2, wherein the correcting means obtains a relationship among the pump flow rate, the pump pressure, and the opening area of the bypass valve during the closed-loop control, and corrects the opening area of the bypass valve corresponding to the operation input of the operation lever during the open-loop control on the basis of the relationship.

Advantageous Effects of the Invention

According to the present invention of claim 1, shifting from the closed-loop control to the open-loop control can be smoothly performed, and the opening area control of the bypass valve in the open-loop control can be performed as a control in consideration of the condition of each time such as hydraulic oil temperatures and individual differences of hydraulic equipment similar to the closed-loop control, and thereby, pump pressure control based on the opening area of the bypass valve can be performed as a control with a high accuracy not affected by the condition of each time.

According to the present invention of claim 2, it is possible to eliminate the fluctuation of the pump pressure resulting from the opening area of the bypass valve becoming discontinuous at the time of shifting from the closed-loop control to the open-loop control, which enables a contributing to the improvement of operability.

According to the invention of claim 3 or 4, the opening area control of the bypass valve in the open-loop control can be performed as a control in consideration of the condition of each time similar to the closed-loop control.

BRIEF DESCRPTION OF THE DRAWINGS

DETAIL DESCRIPTION OF EMBODIMENTS

Figure 1:
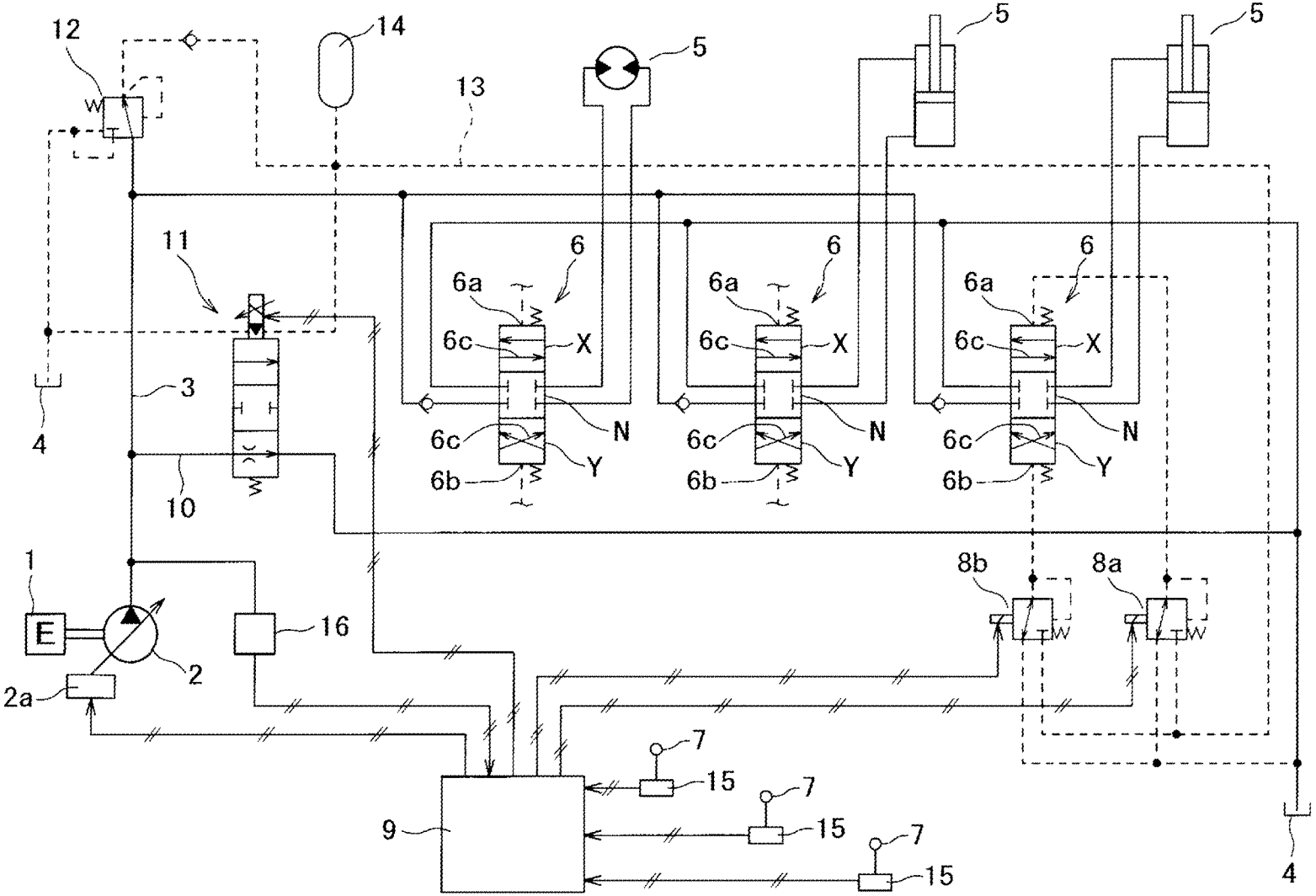
FIG. 1 is a hydraulic control circuit diagram of a working machine.

Hereinbelow, embodiments of the present invention will be described with reference to the drawings. FIG. 1 is a diagram illustrating a hydraulic control circuit provided in a working machine such as a hydraulic shovel. In FIG. 1, reference numeral 1 denotes an engine mounted on the working machine, and 2 denotes a hydraulic pump of variable displacement type driven by the engine 1, 2*a* denotes a pump displacement varying means (displacement varying means of the hydraulic pump 2) for making the displacement of the hydraulic pump 2 variable according to a control signal from a controller 9 as described below, 3 denotes a discharge line of the hydraulic pump 2, 4 denotes an oil tank, 5 denotes a plurality of hydraulic actuators that drive the hydraulic pump 2 as a hydraulic supply source, and 6 denotes control valves for performing oil supply/discharge control to/from each of the hydraulic actuators 5 respectively on the basis of an operation of the corresponding operation lever 7. Three hydraulic actuators 5 are illustrated in FIG. 1 as a plurality of hydraulic actuators, but needless to say, it is not limited thereto. For example, in hydraulic shovels, a number of hydraulic actuators, such as left and right traveling motors, revolving motors, boom cylinders, arm cylinders, bucket cylinders, etc. are provided.

The control valve 6 is a spool valve equipped with pilot ports 6*a*, 6*b*. The control valve 6, when a pilot pressure is not input to the pilot ports 6*a*, 6*b*, is located in a neutral position N where oil supply/discharge control to/from the hydraulic actuator 5 is not performed; however, by the pilot pressure being input to the pilot ports 6*a*, 6*b*, the control valve 6 is displaced to an operating position X or Y with a displacement direction and a displacement amount corresponding to the pilot pressure, and a supply valve passage 6*c* for supplying discharge oil of the hydraulic pump 2 to the hydraulic actuator 5 is opened, so that the discharge oil of the hydraulic pump 2 is supplied to the hydraulic actuator 5 in a state direction control and flow rate control has been effected.

Reference numerals 8*a*, 8*b* also denote electromagnetic proportional pilot valves for outputting pilot pressures to the pilot ports 6*a*, 6*b* of the control valve 6. The pilot valves 8*a*, 8*b* output a pilot pressure corresponding to an operation input of the operation lever 7, on the basis of a control signal output from the controller 9. Then, the oil supply/discharge control to/from the hydraulic actuator 5 corresponding to the operation of the operation lever 7 is performed, by the control valve 6 being displaced in a displacement direction and at a displacement amount corresponding to the pilot pressure output from the pilot valves 8*a,* 8*b*. The pilot valves 8*a,* 8*b* are provided respectively for each of the control valves 6. In FIG. 1, only the pilot valves 8*a,* 8*b* for outputting the pilot pressure to one control valve 6 (the control valve 6 at the right end) are illustrated, and the pilot valves for other control valves 6 are omitted.

Reference numeral 10 denotes a bypass oil passage formed by being branched from the discharge line 3 of the hydraulic pump 2 and extending to the oil tank 4. In the bypass oil passage 10, there is disposed a bypass valve 11 for controlling a flow rate of the bypass oil passage 10. The bypass valve 11 is configured such that the opening area is variably controlled on the basis of a control signal from the controller 9 from a fully open position at which the bypass oil passage 11 is fully opened to a fully closed position at which the bypass oil passage is fully closed.

Reference numeral 12 also denotes a pressure reducing valve for pilot pressure source connected to the discharge line 3 of the hydraulic pump 2. The pressure reducing valve 12 for pilot pressure source reduces the discharge pressure of the hydraulic pump 2 down to a predetermined pressure and outputs it to a pilot pressure supply oil passage 13. The pilot pressure supply oil passage 13 is an oil passage serving as a pilot pressure supply source for the pilot valves 8*a,* 8*b* and the bypass valve 11. An accumulator 14 for maintaining the pilot pressure supply oil passage 13 at a predetermined pressure is connected to the pilot pressure supply oil passage 13. Of course, the pilot pressure supply source can be configured even by a circuit using a general pilot pump.

Figure 2:
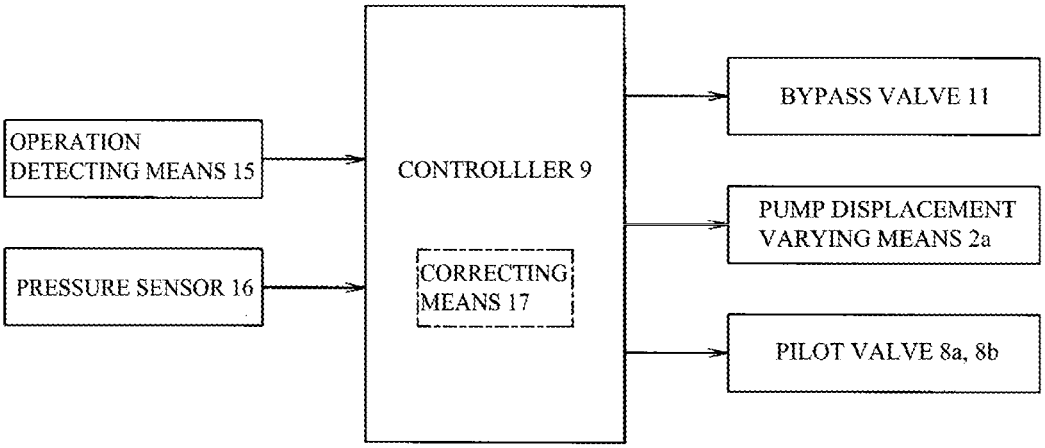
FIG. 2 is a block diagram illustrating input/output of a controller.

On the other hand, as illustrated in the block diagram of FIG. 2, on the input side, the controller 9 is connected to an operation detecting means 15 for detecting an operation direction and an operation input of each operation lever 7, and a pressure sensor 16 for detecting the discharge pressure of the hydraulic pump 2 and the like. Meanwhile, on the output side, the controller 9 is connected to the bypass valve 11, the pump displacement varying means 2*a,* the pilot valves 8*a,* 8*b* for the respective control valves, and the like. The controller 9 is configured to perform various controls such as pump control for outputting control signals to the bypass valve 11 and the pump displacement varying means 2*a* on the basis of input signals to control the flow rate and pressure of the hydraulic pump 2, and hydraulic actuator control for outputting control signals to the pilot valves 8*a,* 8*b* to control the operation of the hydraulic actuator 5.

Next, the pump control performed by the controller 9 will be described with reference to FIG. 3.

First, the controller 9 determines non-operation or operation of the operation lever 7 based on a detection signal from the operation detecting means 15. Then, when it is determined as non-operation of the operation lever 7, the controller 9 outputs a control command to the pump displacement varying means 2*a* to set the flow rate of the hydraulic pump 2 to a minimum flow rate, and the controller 9 outputs a control signal to vary the opening area so as to hold the discharge pressure of the hydraulic pump 2 at a set pressure that is previously set by feeding back the detection value of the pressure sensor 16, to the bypass valve 11. Consequently, the closed-loop flow control will be performed, in which the opening area of the bypass valve 11 is controlled such that such that the pump flow rate is maintained at the minimum flow rate, and the pump pressure is maintained at the set pressure, during the non-operation of the operation lever 7. As a result, lowering fuel consumption can be fulfilled, and improvement of the responsiveness at the time of starting the operation of the operation lever 7 can be fulfilled, because the pressure of the discharge line 3 is maintained at the set pressure.

Figure 3:
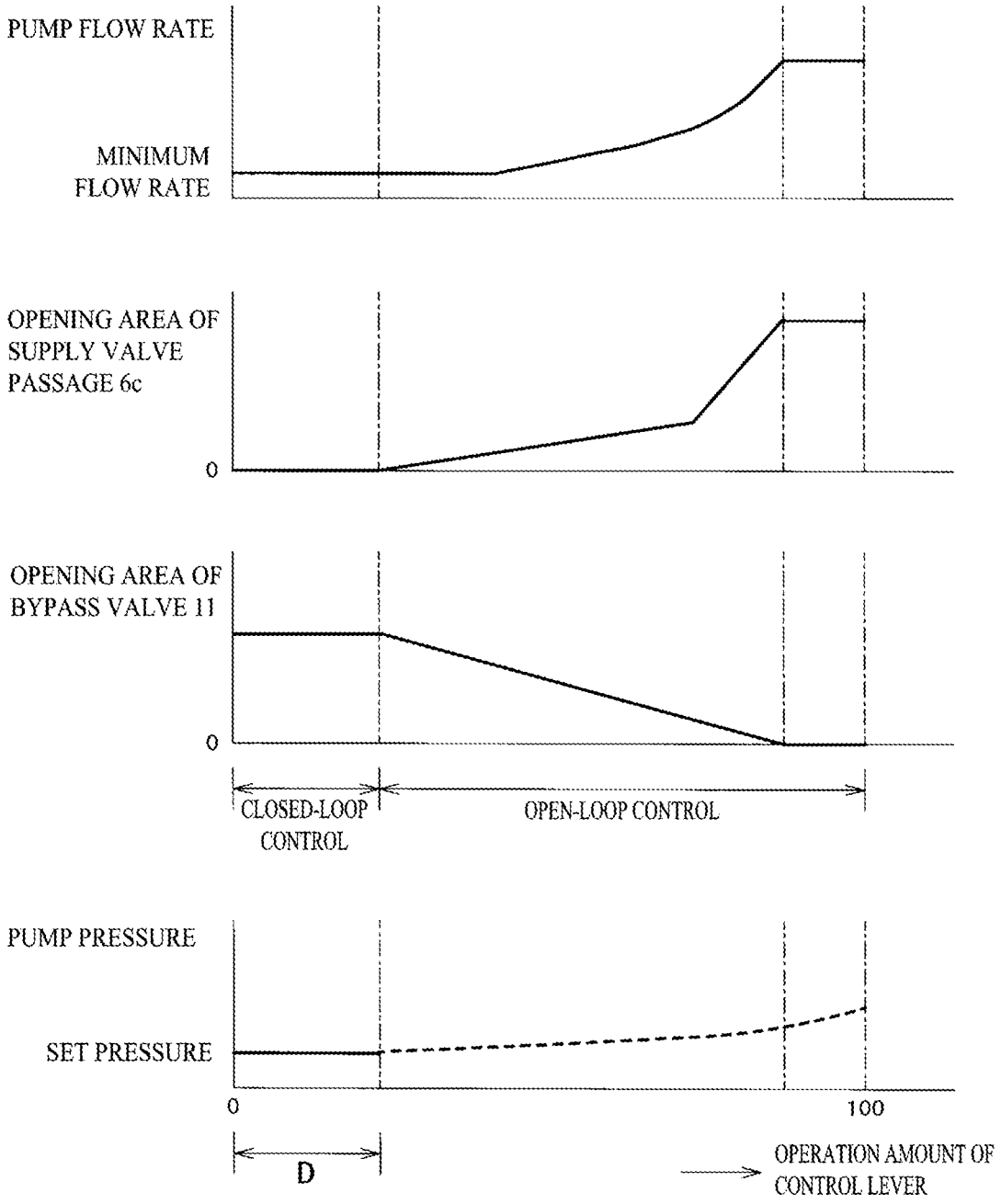
FIG. 3 is graphs illustrating relationships among operation input of an operation lever and pump flow rate/opening area of a supply valve passage of a control valve/opening area of a bypass valve/pump pressure.

In the present embodiment, upon determining non-operation or operation of the operation lever 7, the controller 9 determines not only the case where the operation lever 7 is not actually operated (the operation input of the operation lever "0" illustrated in FIG. 3), but including an operation within a dead zone D of the operation lever 7, as the non-operation of the operation lever 7. The dead zone D of the operation lever 7 in this case refers to an operation range of the operation lever 7 in a state where the control valve 6 is located near the neutral position N and the supply valve passage 6*c* is closed even when the operation lever 7 is operated. As illustrated in FIG. 3, by the operation of the operation lever 7 beyond the dead zone D, the supply valve passage 6*c* of the control valve 6 is opened and pressurized oil supply to the hydraulic actuator 5 is started, and the opening area of the supply valve passage 6*c* increases depending on the increase in the operation input of the operation lever 7, and thus the amount of pressurized oil supply to the hydraulic actuator 5 increases.

On the other hand, when it is determined that the operation lever 7 has been operated (the operation beyond the dead zone D, as described above), the controller 9 outputs a control command to obtain a pump flow rate corresponding to the operation input of the operation lever 7 (operation input of operation lever), to the pump displacement varying means 2*a,* that is, to increase a pump flow rate depending on an increase in the operation input of the operation lever 7, and outputs a control command to perform open-loop control for reducing the opening area of the bypass valve 11 depending on the increase in the operation input of the operation lever 7, to the bypass valve 11. Consequently, the pump flow rate is increased depending on the increase in the operation input of the operation lever 7, and the pump pressure is increased due to the decrease in the opening area of the bypass valve 11, and thereby the pump flow rate and the pump pressure can be increased, in correspondence with the increase in the amount of pressurized oil supply to the hydraulic actuator 5 associated with the increase in the operation input of the operation lever 7, and thus improvement of working efficiency can fulfilled.

Furthermore, the controller 9 is equipped with a correcting means 17, upon outputting a control signal to the bypass valve 11 in the closed-loop control, for correcting a correspondence relationship between the operation input of the operation lever 7 and the opening area of the bypass valve 11, based on the opening area of the bypass valve 11 during the open-loop control. The control signal is output to the bypass valve 11 in a state where the correction by the correcting means 17 has been performed during the open-loop control.

Figure 4:
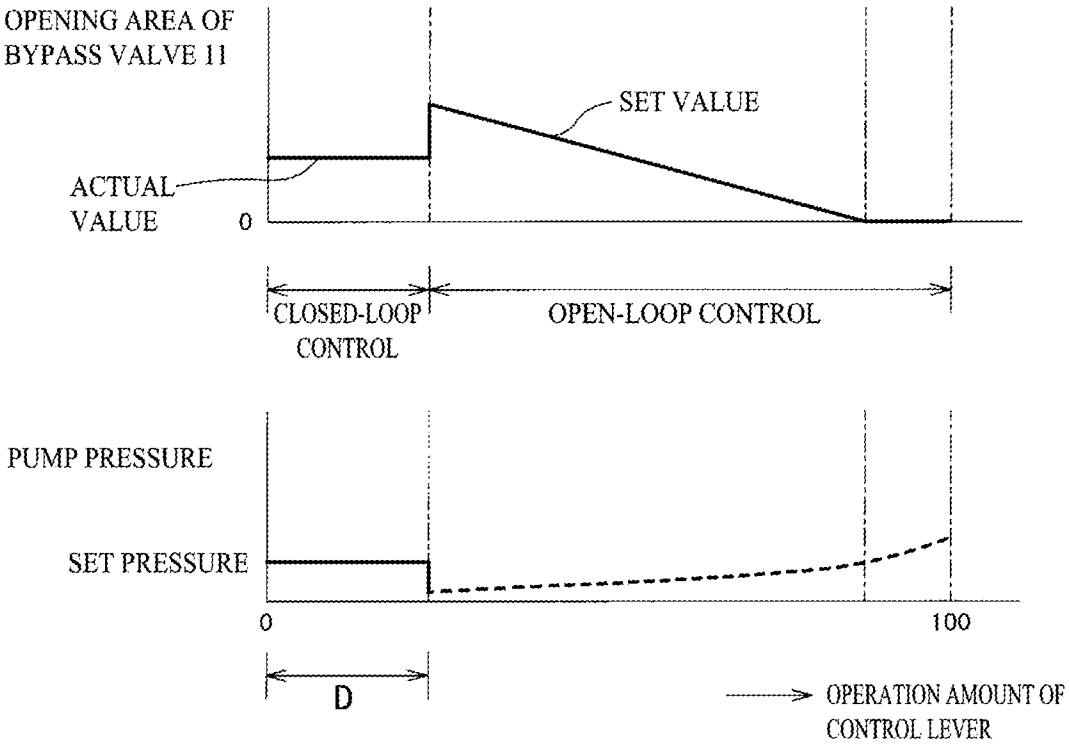
FIG. 4 is graphs illustrating relationships between operation input of the operation lever and opening area of the bypass valve/pump pressure, in a case where correspondence relationship between operation input of the operation lever and opening area of the bypass valve is previously set in the open-loop control.

In other words, in the closed-loop control, because the opening area of the bypass valve 11 is variably controlled so that the discharge pressure of the hydraulic pump 2 is maintained at the set pressure, the opening area of the bypass valve 11 takes a different value each time due to the temperature of the hydraulic oil and individual differences of hydraulic equipment. On the other hand, the opening area of the bypass valve will be determined depending on the operation input of the operation lever 7 during the open-loop control, but in this case, if the opening area of the bypass valve 11 during the open-loop control is a set value that has been previously set with respect to the operation input of the operation lever, as illustrated in FIG. 4, a difference may be generated between the actual opening area (actual value) of the bypass valve 11 during the closed-loop control and the opening area of the bypass valve 11 at the time of starting the open-loop control and the opening area may become discontinuous. When the opening area of the bypass valve 11 becomes discontinuous in this way, the pump pressure suddenly fluctuates at the discontinuous point, which becomes a factor which deteriorates operability. Further, if the opening area of the bypass valve 11 corresponding to the operation input of the operation lever in the open-loop control is a set value that has been previously set irrespective of the conditions such as the temperatures of hydraulic oil and individual differences of hydraulic equipment, opening area control of the bypass valve 11 in consideration of the condition of each time will be unable to be effected. Thus, the correspondence relationship between the operation input of the operation lever and the opening area of the bypass valve 11 in the open-loop control is corrected based on the basis of the opening area of the bypass valve 11 in the closed-loop control, by the correcting means 17, thereby generation of discontinuity of the opening area of the bypass valve 11 at the time of shifting from the closed-loop control to the open-loop control can be avoided, and the opening area control of the bypass valve 11 can be effected in consideration of the condition of each time in the open-loop control.

Next, a correction performed by the correcting means 17 will be described, but the correction varies depending on a way how to set the relationship between the operation input of the operation lever 7 and the opening area of the bypass valve 11 in the open-loop control. Accordingly, as a Correction Example 1, a correction in a case where the relationship between the operation input of the operation lever and the opening area of the bypass valve 11 is set as a unique relationship will be described, and as a Correction Example 2, a correction in a case where the relationship between the operation input of the operation lever and the opening area of the bypass valve 11 is set so as to obtain the pump pressure which is set depending on the operation input of the operation lever will be described.

Figure 5:
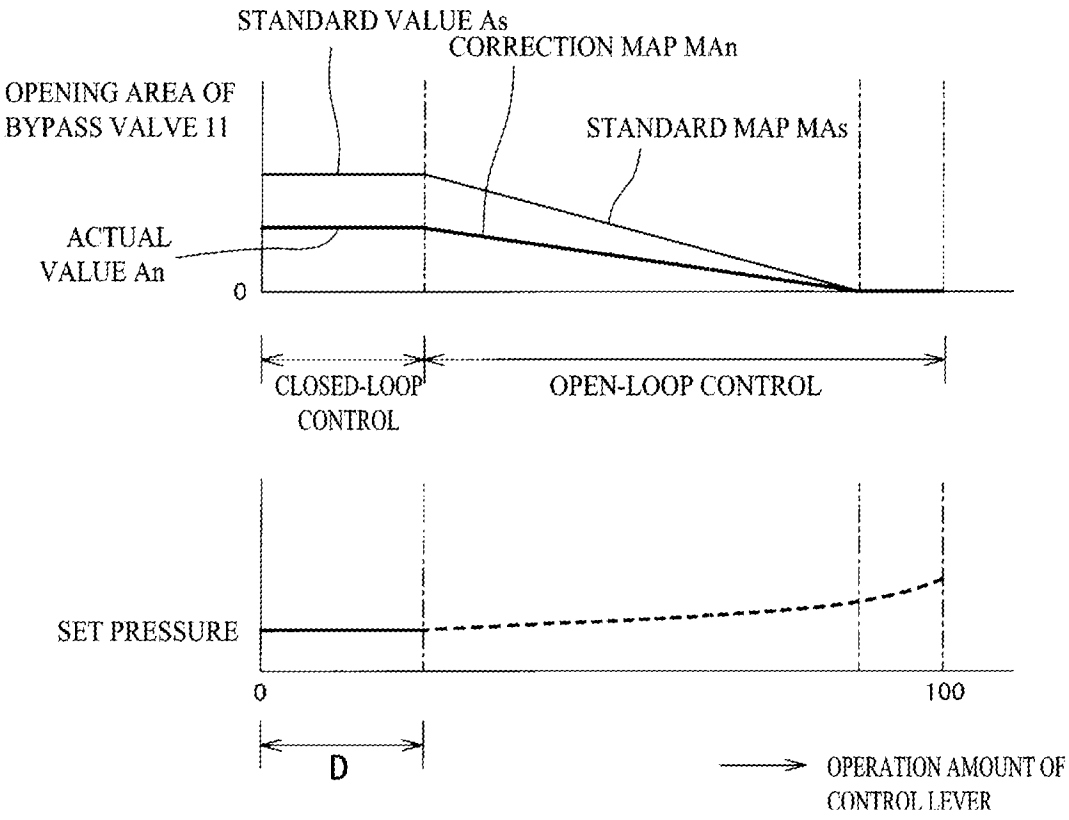
FIG. 5 is graphs illustrating relationships between operation input of the operation lever and opening area of the bypass valve/pump pressure in Correction Example 1.

First, the Correction Example 1 will be described with reference to FIG. 5. The Correction Example 1 is a case where a relationship between the operation input of the operation lever and the opening area of the bypass valve 11 (hereinafter, an opening area of the bypass valve 11 is also referred to as a bypass opening) in the open-loop control is set as a unique relationship. Specifically, a standard value "As" of the bypass opening for maintaining the pump pressure at the set pressure during the closed-loop control is previously set. In addition, supposing the standard value "As" to be an initial value of the bypass opening at the time of starting the open-loop control, the relationship between the operation input of the operation lever and the bypass opening in the open-loop control, that is, a relationship in which the bypass opening is decreased depending on the increase in the operation input of the operation lever is previously set as a standard map "MAs". If such a standard map "MAs" is set, the correction is performed as follows: first a ratio R (R=An/As) between the actual value An of the opening area of the bypass valve for maintaining the pump pressure at the set pressure in the closed-loop control and the standard value As is obtained, and then a value of the correction map MAn (MAn=C×MAs) is obtained by multiplying the value of the standard map MAs by the ratio R. In the open-loop control, the bypass valve 11 is controlled so as to have an opening area which corresponds to the operation input of the operation lever, using the correction map MAn created that way. As a result, the opening area of the bypass valve 11 at the time of starting the open-loop control becomes equal to the opening area of the bypass valve 11 during the closed-loop control, and generation of the discontinuity of the bypass opening at the time of shifting from the closed-loop control to the open-loop control can be avoided, and also in the open-loop control, the opening area control of the bypass valve 11 which corresponds to the condition of each time can be effected, similarly to the closed-loop control.

Figure 6A:
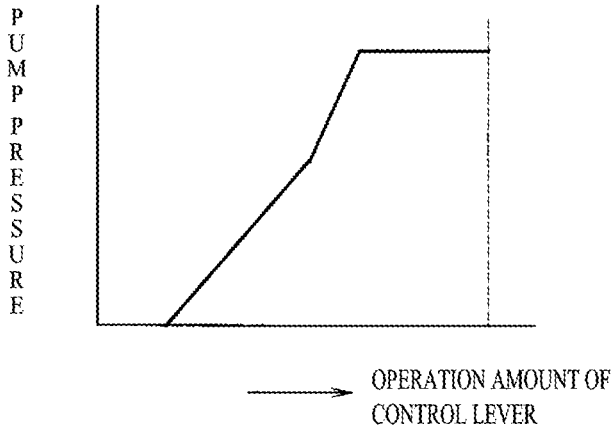
FIG. 6A is a map illustrating a relationship between operation input of the operation lever and pump pressure in a Correction Example 2.
Figure 6B:
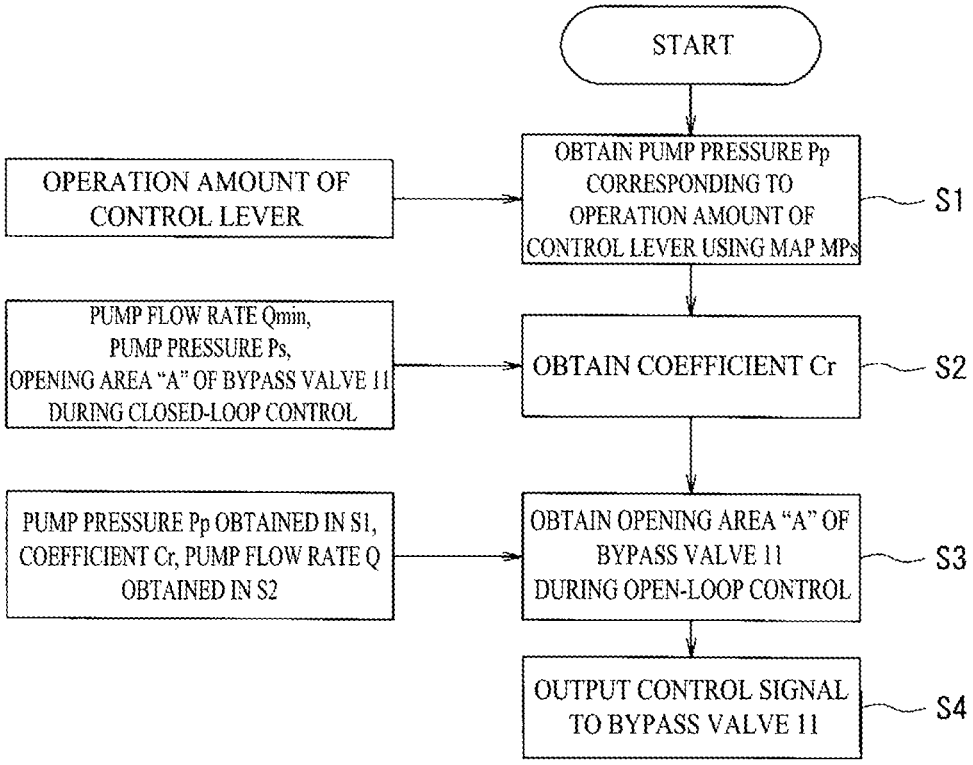
FIG. 6B is a flowchart illustrating a control procedure of the Correction Example 2.

Next, the Correction Example 2 will be described. The Correction Example 2 is a case where the correspondence relationship between the operation input of the operation lever and the pump pressure in the open-loop control is previously set as a map MPs (see FIG. 6A), and the opening area of the bypass valve 11 is set so as to be controlled based on the map MPs and the pump flow rate. In a case of setting that way, in order to correct the opening area of the bypass valve 11 corresponding to the operation input of the operation lever in the open-loop control, first, the pump pressure Pp corresponding to the operation input of the operation lever which is input from the operation detecting means 15 is obtained, by using the map MPs indicating the relationship between the operation input of the operation lever and the pump pressure, as illustrated in the flowchart of FIG. 6A (step S1).

Next, a coefficient Cr to be used in the equation (2) as described below is obtained by inputting the pump flow rate (minimum pump flow rate, in the present embodiment) Qmin, the pump pressure (set pressure) Ps, and the actual value An of the bypass opening during the closed-loop control to the following equation (1) (step S2).

$$Q\min = Cr \times An \times (Ps)1/2 \quad (1)$$

The coefficient Cr obtained using the above equation (1) is a coefficient calculated using the actual value in the closed-loop control, and is obtained as a variable including a change in the density of the hydraulic oil.

Next, the opening area A of the bypass valve 11 corresponding to the operation input of the operation lever during the open-loop control is obtained, by inputting the pump pressure Pp corresponding to the operation input of the operation lever obtained in the step S1, the coefficient Cr obtained in the step S2, and the pump flow rate Q corresponding to the operation input of the operation lever to the following equation (2) (step S3).

$$Q = Cr \times A \times (Pp)1/2 \quad (2)$$

A control signal is output to the bypass valve 11 so as to be equal to the opening area obtained by using the above equation (2) (step S4).

As a result, the bypass opening during the open-loop control takes a value corrected under the condition during the closed-loop control (the pump flow rate (minimum flow rate), the pump pressure (set pressure) and the actual value of the bypass opening during the closed-loop control), the generation of discontinuity of the bypass opening at the time of shifting from the closed-loop control to the open-loop control can be avoided, and also in the open-loop control, opening area control of the bypass valve 11 according to the condition of each time can be effected, similarly to the case during the closed-loop control.

The values of the pump flow rate Qmin and Q in the above equations (1) and (2) are the pump flow rate values used when outputting a control signal from the controller 9 to the pump displacement varying means 2*a*. The pump pressure Pp in the equation (2) is also used as a value of the differential pressure ΔP before and behind the bypass valve 11 (Pp≈ΔP), assuming that the tank pressure is substantially zero (≈0).

Meanwhile, the hydraulic control circuit of the working machine is provided with a hydraulic lock means, though not illustrated. A hydraulic lock means is used for bringing into a hydraulic locked state in which, unless the hydraulic lock means is released, pressurized oil supply is not performed to the hydraulic actuator 5 even when the operation lever 7 is operated (the hydraulic actuator 5 does not operate). The hydraulic lock means is configured to use, for example, a hydraulic lock lever (not illustrated) disposed in an operator's cab, and an unload valve (not illustrated) for bringing the pilot pressure supply oil passage 13 into an unloaded state based on an operation of the hydraulic lock lever. If the hydraulic lock means is not released, that is, in a hydraulic locked state in which the hydraulic actuator 5 does not operate even when the operation lever 7 is operated, the controller 9 outputs a control signal to regulate the flow rate of the hydraulic pump 2 to a minimum flow rate, to the pump displacement varying means 2*a,* and outputs a control signal to the bypass valve 11 to locate it at a fully open position at which the bypass oil passage 10 is fully opened. As a result, the pump discharge pressure is reduced, because the pump flow rate is maintained at the minimum flow rate, and the bypass oil passage 10, which allows the discharge oil of the hydraulic pump 2 to flow into the oil tank 4, is fully open. Accordingly, low fuel consumption in the hydraulic locked state can be achieved. The operation and non-operation of the operation lever in the present invention does not include operation and non-operation of the operation lever 7 in the hydraulic locked state.

In the present embodiment configured as described above, a hydraulic control circuit for a working machine includes a hydraulic pump 2 of variable displacement type, a hydraulic actuator 5 that drives the hydraulic pump 2 as a hydraulic supply source, a control valve 6 for performing oil supply/discharge controls to/from the hydraulic actuator 5 based on an operation of an operation lever 7, a bypass oil passage 10 formed by being branched from a discharge line 3 of the hydraulic pump 2 and extending to an oil tank 4, a bypass valve 11 having a variable opening area for controlling a flow rate of the bypass oil passage 10, and a controller 9 for controlling a displacement varying means 2*a* of the hydraulic pump 2 and the bypass valve 11, and the controller 9 performs closed-loop control for maintaining a pump flow rate constant (minimum flow rate), and controlling an opening area of the bypass valve so that a pump pressure is maintained at a set pressure, during non-operation of the operation lever 7 (including an operation within the dead zone D of the lever 7), and on the other hand, performs open-loop control for increasing the pump flow rate according to the operation input of the operation lever 7, and reducing an opening area of the bypass valve according to an operation input of the operation lever, during an operation of the operation lever 7 (an operation beyond the dead zone D of the operation lever 7). As a result, the pump pressure is maintained at the set pressure in a stable state during the non-operation of the operation lever 7, and thus low fuel consumption can be achieved, and the other hand, the pump flow rate and the pump pressure are increased depending on the operation input of the operation lever during the operation of the operation lever 7, and thus improvement of working efficiency can be achieved. Furthermore in the hydraulic control unit, the controller 9 is equipped with a correcting means 17 for correcting a correspondence relationship between the operation input of the operation lever and the opening area of the bypass valve in the open-loop control, based on the opening area of the bypass valve 11 during the closed-loop control.

As described above, in the present embodiment, the controller 9 performs closed-loop control of the opening area of the bypass valve 11 that performs flow rate control of the bypass oil passage 10 formed by being branched from the discharge line 3 of the hydraulic pump 2 and extending to the oil tank 4, so that the pump pressure be maintained at the set pressure during the non-operation of the operation lever 7, and on the other hand, performs open-loop control so that the opening area is increased in correspondence with the operation input of the operation lever during the operation of the operation lever 7, and thereby, low fuel consumption and improved working efficiency can be achieved. Despite the above fact, the correspondence relationship between the operation input of the operation lever and the opening area of the bypass valve 11 can be corrected based on the opening area of the bypass valve 11 during the closed-loop control, by the correcting means 17. As a result, shifting from the closed-loop control to the open-loop control can be smoothly performed, and the opening area control of the bypass valve 11 in the open-loop control can be performed as a control in consideration of the same conditions as those during the closed-loop control, that is, the condition of each time such as the operating oil temperatures and individual differences of hydraulic equipment, and therefore the hydraulic pressure control based on the opening area of the bypass valve 11 can be performed as a control with a high accuracy not affected by the condition of each time.

In the hydraulic control unit, the correcting means 17 is configured to control the opening area of the bypass valve 11 at the time of starting the open-loop control so that the opening area of the bypass valve 11 does not become discontinuous at the time of shifting from the closed-loop control to the open-loop control. As a result, it is possible to eliminate the fluctuation of the pump pressure due to the opening area of the bypass valve 11 becoming discontinuous at the time of shifting from the closed-loop control to the open-loop control, which can contribute to the improvement of operability.

Furthermore in the hydraulic control unit, upon correcting the correspondence relationship between the operation input of the operation lever and the opening area of the bypass valve 11 in the open-loop control by the correcting means 17, the correcting means 17 is provided with a standard map MAs indicating a correspondence relationship between the operation input of the operation lever and the opening area of the bypass valve 11 in the open-loop control, and is configured to correct the standard map MAs based on the opening area of the bypass valve 11 during the closed-loop control, and thereby the opening area control of the bypass valve 11 in the open-loop control can be performed as a control in consideration of the conditions of each time similarly to the closed-loop control.

Further, the correcting means 17 can be configured to obtain the relationship among the pump flow rate, the pump pressure, and the opening area of the bypass valve during the closed-loop control, by the correcting means 17, and to correct the opening of the bypass valve corresponding to the operation input of the operation lever during open-loop control based on the relationship. Even it is configured in this way, the opening area control of the bypass valve 11 in the open-loop control can be performed as a control in consideration of the condition of each time similarly to the closed-loop control.

INDUSTRIAL APPLICABILITY

The present invention can be utilized for hydraulic control circuits for working machines, such as hydraulic shovels.

The invention claimed is:

1. A hydraulic control circuit for a working machine, the hydraulic control circuit comprising:

a hydraulic pump of variable displacement type;

a hydraulic actuator driven by the hydraulic pump as a hydraulic supply source;

a control valve for performing oil supply/discharge controls to/from the hydraulic actuator on the basis of an operation of an operation lever;

a bypass oil passage formed by being branched from a discharge line of the hydraulic pump and extending to an oil tank;

a bypass valve having a variable opening area for controlling a flow rate of the bypass oil passage; and a controller for controlling a displacement varying means of the hydraulic pump and the bypass valve, wherein the controller, performs closed-loop control for maintaining a pump flow rate constant, and controlling an opening area. of the bypass valve so that a pump pressure is maintained at a set pressure, during non-operation of the operation lever, and on the other hand, performs open-loop control for increasing the pump flow rate depending on the operation input of the operation lever, and reducing an opening area of the bypass valve depending on the operation input of the operation lever, during operation of the operation lever, and wherein the controller comprises a correcting means for correcting a correspondence relationship between the operation input of the operation lever and the opening area of the bypass valve in the open-loop control, on the basis of the opening area of the bypass valve during the closed-loop control.

2. The hydraulic control circuit for the working machine according to claim 1, wherein the correcting means controls the opening area of the bypass valve at the time of starting the open-loop control so that the opening area. of the bypass valve does not become discontinuous at the time of shifting from the closed-loop control to the open-loop control.

3. The hydraulic control circuit for the working machine according to claim 1, wherein the correcting means includes a standard map indicating a correspondence relationship between an operation input of the operation lever and an opening area of the bypass valve in the open-loop control, and corrects the standard map on the basis of the opening area of the bypass valve during the closed-loop control.

4. The hydraulic control circuit for the working machine according to claim 1, wherein the correcting means obtains a relationship among the pump flow rate, the pump pressure, and the opening area of the bypass valve during the closed-loop control, and corrects the opening area of the bypass valve corresponding to the operation input of the operation lever during the open-loop control on the basis of the relationship.

* * * * *